US007687141B2

(12) United States Patent
Yabuki

(10) Patent No.: US 7,687,141 B2
(45) Date of Patent: Mar. 30, 2010

(54) NEAR-INFRARED ABSORBING FIBER COMPRISING TUNGSTEN OXIDE, AND FIBER ARTICLE USING SAME

(75) Inventor: Kayo Yabuki, Ichikawa (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 362 days.

(21) Appl. No.: 11/665,009

(22) PCT Filed: Oct. 24, 2005

(86) PCT No.: PCT/JP2005/019484

§ 371 (c)(1),
(2), (4) Date: Apr. 26, 2007

(87) PCT Pub. No.: WO2006/049025

PCT Pub. Date: May 11, 2006

(65) Prior Publication Data

US 2008/0308775 A1 Dec. 18, 2008

(30) Foreign Application Priority Data

Nov. 8, 2004 (JP) ..... 2004-323554

(51) Int. Cl.
*B32B 5/16* (2006.01)

(52) U.S. Cl. ..... 428/328; 428/364; 428/365; 428/372; 428/375; 428/379; 428/389; 428/392

(58) Field of Classification Search ..... 428/328, 428/364, 365, 372, 375, 379, 389, 392, 396, 428/402, 403
See application file for complete search history.

(56) References Cited

U.S. PATENT DOCUMENTS

| | | | | |
|---|---|---|---|---|
| 2,965,139 | A * | 12/1960 | De Thier | 139/426 R |
| 4,762,749 | A * | 8/1988 | Schuetz | 428/372 |
| 4,833,013 | A * | 5/1989 | Schuetz | 442/338 |
| 6,858,551 | B1 | 2/2005 | Turkevich et al. | |
| 7,074,351 | B2 * | 7/2006 | Dobler et al. | 252/587 |
| 7,169,834 | B2 * | 1/2007 | Dobler et al. | 524/10 |
| 2003/0072840 | A1 * | 4/2003 | Kappelmuller et al. | 425/542 |
| 2003/0122114 | A1 | 7/2003 | Dobler et al. | |
| 2004/0106008 | A1 * | 6/2004 | Siggel et al. | 428/690 |
| 2008/0241542 | A1 * | 10/2008 | Ohtani et al. | 428/403 |

FOREIGN PATENT DOCUMENTS

| | | |
|---|---|---|
| CN | 1226293 A | 8/1999 |
| JP | A 02-157040 | 6/1990 |
| JP | A 05-239716 | 9/1993 |
| JP | A 07-328421 | 12/1995 |
| JP | A 08-003870 | 1/1996 |
| JP | A 08-144125 | 6/1996 |
| JP | A 09-291463 | 11/1997 |
| JP | A 11-152611 | 6/1999 |
| JP | A 11-279830 | 10/1999 |
| JP | A-2003-155639 | 5/2003 |
| JP | A 2003-155639 | 5/2003 |
| JP | A 2005-009024 | 1/2005 |
| WO | WO 97/44509 | 11/1997 |
| WO | WO 01/59003 A1 | 8/2001 |

OTHER PUBLICATIONS

Gunnar A. Niklasson et al; Polaron absorption in tungsten oxide nanoparticle aggregates; Electrochimica; Aug. 23, 2000, revised Nov. 9, 2000; pp. 1967-1971; Department of Materials Science, The Angstrom Laboratory, Uppsala University, Uppsala, Sweden.

Zhi Yuan Wang et al; Near-infrared absorbing organic materials; Pure Appl. Chem.; 2004; pp. 1435-1443; vol. 76, Nos. 7-8; Department of Chemistry, Carleton University, Ottawa, Canada.

* cited by examiner

*Primary Examiner*—H. (Holly) T Le
(74) *Attorney, Agent, or Firm*—Oliff & Berridge, PLC

(57) ABSTRACT

An inexpensive fiber that has heat retaining properties, satisfactory weather resistance and heat absorption efficiency, and includes a heat absorbing material having excellent transparency; and a fiber article that uses the fiber. A particle dispersion of $Cs_{0.33}WO_3$ is obtained by mixing $Cs_{0.33}WO_3$ microparticles, toluene, and a microparticle dispersing agent to create a liquid dispersion, and then removing the toluene. The particle dispersion is added to and uniformly mixed with pellets of polyethylene terephthalate resin, after which the mixture is extruded, the strands thus obtained are formed into pellets, and a master batch including $Cs_{0.33}WO_3$ microparticles is obtained. This master batch is mixed with a master batch to which inorganic microparticles have not been added, and the mixture thus obtained is melt spun and stretched to manufacture a polyester multifilament yarn. The polyester multifilament yarn is cut, polyester staple fibers are created, and a spun yarn is manufactured. A heat retentive knit article is obtained using the spun yarn.

11 Claims, No Drawings

NEAR-INFRARED ABSORBING FIBER COMPRISING TUNGSTEN OXIDE, AND FIBER ARTICLE USING SAME

TECHNICAL FIELD

The present invention relates to a fiber that includes a material for absorbing infrared rays from sunlight and the like, and to a fiber article that has high heat retention and is fabricated using the aforementioned fiber.

BACKGROUND ART

Various types of winter garments, interiors, and leisure goods having increased heat retaining effects have been proposed and implemented. There are two main methods of increasing heat retaining effects. In the first method, the dissipation of heat generated from the human body is reduced, and heat retention properties are maintained by such methods as controlling the weave and knit structure in the winter garment or making the fibers hollow or porous, for example, to physically increase the number of air layers in the winter garment. In the second method, heat is accumulated and heat retention properties are enhanced in the winter garment, for example, by such active methods as chemically/physically processing the garment as a whole or the fibers that constitute the winter garment so as to radiate the heat generated from the body back towards the body, convert a portion of the sunlight received by the winter garment into heat, and produce other effects.

Methods such as increasing the number of air layers in the garment, increasing the thickness of the fabric, increasing the fineness of the weave, or darkening the color have been employed as examples of the first category of methods described above. These methods are used in sweaters and other garments that are used in winter, for example. In garments that have been widely used as winter sports apparel, for example, an inner filling is provided between the outer layer and the lining, and heat retention properties are maintained by the thickness of the air layer of the inner filling. However, the garment becomes heavy and bulky when an inner filling is added, making the garment unsuitable for sports that require freedom of movement. In order to overcome these drawbacks, methods in the above-mentioned second category have recently come into use that actively and effectively utilize internally generated heat and external heat.

One type of method for implementing the second category of methods includes known methods whereby aluminum, titanium, or another metal is deposited on the lining or the like of a garment to actively prevent the emanation of heat by using the metal deposited surface to reflect heat that is radiated from the body. However, not only is it considerably expensive to vapor deposit a metal in the garment by these methods, but uneven deposition and other defects reduce the manufacturing yield, which effectively raises the price of the product itself.

Another method that has been proposed as an implementation of the second category of methods involves kneading alumina, zirconia, magnesia, and other ceramic particles into the fibers as such to utilize the far infrared radiating effects or photothermal conversion effects of the inorganic microparticles, i.e., to actively absorb external energy.

For example, Patent Document 1 describes a technique in which inorganic microparticles of silica, barium sulfate, or the like having heat radiating characteristics are prepared that include at least one type of species selected from metal ions and metals that have a heat conductivity of 0.3 kcal/m$^2$·sec·C° or higher, heat radiating fibers are manufactured that include one or more types of the inorganic microparticles, and the fibers are used to enhance heat retention properties.

Patent Document 2 discloses that excellent heat retention properties are demonstrated in a fiber that includes aluminum oxide microparticles as well as ceramic microparticles contained in an amount of 0.1 to 20 wt % with respect to the fiber weight and capable of absorbing and converting light to heat and radiating far infrared rays.

Patent Document 3 describes the proposal of an infrared absorbing processed fiber article that is formed by dispersing and fixing an infrared absorbing agent composed of an amino compound, and a binder resin that includes an ultraviolet absorbing agent and various types of stabilizers that are used as needed.

Patent Document 4 proposes a near infrared absorption processing method for obtaining a cellulose-based fiber structure that absorbs near infrared rays (in the near infrared wavelength range of 750 to 1500 nm, wherein the spectral reflectance of the material is 65% or lower) by dyeing the structure with a combination of a dye and another dye that is selected from the group consisting of a substantive dye, a reactive dye, a naphthol dye, and a vat dye, whose absorption in the near infrared region is greater than that of a black dye.

In Patent Document 5, the present inventors propose a fiber that includes hexaboride microparticles as a heat absorbing component that is selected as a material that has high reflectance and low transmittance of light in the near infrared region in spite of having high transmittance and low reflectance of visible light. The inventors also propose a fiber article that is manufactured using the aforementioned fiber.

[Patent Document 1]: JP-A 11-279830

[Patent Document 2]: JP-A 5-239716

[Patent Document 3]: JP-A 8-3870

[Patent Document 4]: JP-A 9-291463

[Patent Document 5]: JP-A 2003-174548

DISCLOSURE OF THE INVENTION

Problems which the Invention is Intended to Solve

When silica or other inorganic particles are prepared that include a metal or the like and have heat radiating characteristics, and heat radiating fibers that include the inorganic microparticles are manufactured, a large quantity of the inorganic microparticles is added with respect to the fibers. The weight of the garment therefore increases due to the increased weight of the fibers, it is extremely difficult to evenly disperse the fibers during melt spinning, and other drawbacks occur. A technique is also known whereby particles of aluminum, titanium, or another metal are bonded to the fibers by adhesion, vapor deposition, or the like to impart radiation reflecting effects and enhance heat retention properties. However, adhesion or vapor deposition causes a significant change in the color of the fibers, thereby limiting the range of applications. Vapor deposition also increases the cost, subtle spotting of the fabric occurs due to handling in the preparation step prior to vapor deposition, the heat retention capability decreases from loss of the deposited metal due to friction during laundering or wear, and other drawbacks occur.

In a method for adding ceramic microparticles and aluminum oxide microparticles to fibers, the infrared absorbing agent used is an organic material, a black dye, or the like. This method therefore has drawbacks of significant degradation due to heat or temperature, and inferior weather resistance. Furthermore, since the fibers are given a dark color by the addition of the abovementioned material, the fibers cannot be used in a light colored article, and the fibers can only be used in a limited range of fields.

When hexaboride microparticles are added to the fibers, higher heat absorption characteristics are needed, and improvements can be made to the heat absorption characteristics of the fibers in order to create a practical fiber article that has heat retention properties.

The present invention was developed to overcome the foregoing drawbacks, and an object of the present invention is to provide an inexpensive heat retaining fiber that includes a near infrared absorbing material on the surface and in the interior, wherein the fiber has good weather resistance, efficiently absorbs heat rays from sunlight or the like using only a small quantity of the fibers, and has excellent transparency so as not to compromise the design properties of a fiber article. An object of the present invention is also to provide a fiber article that uses the aforementioned fiber.

Means Used to Solve the Above-Mentioned Problems

As a result of concentrated investigation, the inventors devised a method for preparing microparticles of a heat absorbing component by pulverizing tungsten oxide and/or composite tungsten oxide to a grain size of 1 nm to 800 nm, and then increasing the amount of free electrons in the microparticles. The inventors then developed the present invention upon discovering that fibers formed by dispersing the microparticles of the heat absorbing component in an appropriate solvent and adding the dispersion to the surface or interior of fibers transmit light in the visible region while simultaneously absorbing sunlight rays, particularly light in the near infrared region, more efficiently than fibers that are created by a spray method or fibers that are created by dry process methods such as sputtering, vapor deposition, ion plating, chemical vapor deposition (CVD), and other vacuum film formation methods even without using an optical interference effect.

Specifically, a first aspect of the present invention provides a fiber that includes tungsten oxide microparticles and/or composite tungsten oxide microparticles in a surface and/or interior of the fiber, wherein the fiber is a near infrared absorbing fiber in which the content of the microparticles is 0.001 wt % to 80 wt % with respect to a solid portion of the fiber.

A second aspect of the present invention is the first aspect wherein the tungsten oxide microparticles and/or composite tungsten oxide microparticles have a grain size of 1 nm to 800 nm.

A third aspect of the present invention is the first aspect wherein the tungsten oxide microparticles are tungsten oxide microparticles indicated by the general formula $WO_X$ (wherein W is tungsten, O is oxygen, and 2.45=X=2.999).

A fourth aspect of the present invention is the first aspect wherein the composite tungsten oxide microparticles are composite tungsten oxide microparticles that have a hexagonal crystal structure and are indicated by the general formula $M_YWO_Z$ (wherein element M is one or more elements selected from H, He, an alkali metal, an alkaline earth metal, a rare earth element, Mg, Zr, Cr, Mn, Fe, Ru, Co, Rh, Ir, Ni, Pd, Pt, Cu, Ag, Au, Zn, Cd, Al, Ga, In, Tl, Si, Ge, Sn, Pb, Sb, B, F, P, S, Se, Br, Te, Ti, Nb, V, Mo, Ta, Re, Be, Hf, Os, Bi, and I; W is tungsten; O is oxygen; $0.001 \leqq Y \leqq 1.0$; and $2.2 \leqq Z \leqq 3.0$).

A fifth aspect of the present invention is the fourth aspect wherein the element M is one or more elements selected from Cs, Rb, K, Tl, In, Ba, Li, Ca, Sr, Fe, and Sn.

A sixth aspect of the present invention provides a fiber in which microparticles of a far infrared radiating substance are furthermore included in the surface and/or interior of the near infrared absorbing fiber of the first aspect, wherein the microparticles are contained in the near infrared absorbing fiber in an amount of 0.001 wt % to 80 wt % with respect to a solid portion of the fiber.

A seventh aspect of the present invention is the first aspect wherein the fiber is a fiber selected from any of a synthetic fiber, a semisynthetic fiber, a natural fiber, a reclaimed fiber, and an inorganic fiber; or a textile blend, doubled yarn, or mixed yarn formed by combining filaments of the same.

An eighth aspect of the present invention is the seventh aspect wherein the synthetic fiber is a synthetic fiber selected from polyurethane fiber, polyamide fiber, acrylic fiber, polyester fiber, polyolefin fiber, polyvinyl alcohol fiber, polyvinylidene chloride fiber, polyvinyl chloride fiber, and polyether ester fiber.

A ninth aspect of the present invention is the seventh aspect wherein the semisynthetic fiber is a semisynthetic fiber selected from cellulose fiber, protein fiber, chlorinated rubber, and hydrochlorinated rubber.

A tenth aspect of the present invention is the seventh aspect wherein the natural fiber is a natural fiber selected from vegetable fiber, animal fiber, and mineral fiber.

An eleventh aspect of the present invention is the seventh aspect wherein the reclaimed fiber is a reclaimed fiber selected from cellulose fiber, protein fiber, algin fiber, rubber fiber, chitin fiber, and mannan fiber.

A twelfth aspect of the present invention is the seventh aspect wherein the inorganic fiber is an inorganic fiber selected from metal fiber, carbon fiber, and silicate fiber.

A thirteenth aspect of the present invention is the first aspect wherein a surface of the tungsten oxide microparticles and/or composite tungsten oxide microparticles is covered by a compound that contains one or more elements selected from silicon, zirconium, titanium, and aluminum.

A fourteenth aspect of the present invention is the thirteenth aspect wherein the compound is an oxide.

A fifteenth aspect of the present invention provides a fiber article that is fabricated using the near infrared absorbing fiber of any of the first through fourteenth aspects.

Effect of the Invention

The near infrared absorbing fiber according to the first through fourteenth aspects includes tungsten oxide microparticles and/or composite tungsten oxide microparticles as a heat absorbing component, whereby the fiber has heat retaining properties and efficiently absorbs heat from sunlight and the like using a small amount of the abovementioned microparticles. The fiber also has the properties of satisfactory weather resistance, low cost, excellent transparency, and no adverse effects on the design properties of a fiber article.

The fiber article according to the fifteenth aspect has excellent heat absorbing characteristics, and can therefore be applied in winter clothing, sports apparel, stockings, curtains, and other fiber articles in which heat retaining properties are required, as well as in industrial fiber materials and various other applications.

BEST MODE FOR CARRYING OUT THE INVENTION

The near infrared absorbing fiber of the present invention is fabricated by uniformly including tungsten oxide microparticles and/or composite tungsten oxide microparticles, which are microparticles having heat absorbing capacity, in various types of fibers. Therefore, the tungsten oxide microparticles and composite tungsten oxide microparticles that are the microparticles having heat absorbing capacity will first be described.

The microparticles having heat absorbing capacity that are used in the present invention are tungsten oxide microparticles indicated by the general formula $WO_X$ (wherein W is tungsten, O is oxygen, and $2.45 \leqq X \leqq 2.999$) and/or composite tungsten oxide microparticles that have a hexagonal crystal structure and are indicated by the general formula $M_YWO_Z$ (wherein element M is one or more elements selected from H, He, an alkali metal, an alkaline earth metal, a rare earth element, Mg, Zr, Cr, Mn, Fe, Ru, Co, Rh, Ir, Ni, Pd, Pt, Cu, Ag, Au, Zn, Cd, Al, Ga, In, Ti, Si, Ge, Sn, Pb, Sb, B, F, P, S, Se, Br, Te, Ti, Nb, V, Mo, Ta, Re, Be, Hf, Os, Bi, and I; W is tungsten; O is oxygen; $0.001 = Y \leqq 1.0$; and $2.2 \leqq Z \leqq 3.0$). The abovementioned tungsten oxide microparticles or composite tungsten oxide microparticles function effectively as a heat absorbing component when applied in various types of fibers.

Examples of the tungsten oxide microparticles indicated by the abovementioned general formula $WO_X$ (wherein $2.45 \leqq X \leqq 2.999$) may include $W_{18}O_{49}$, $W_{20}O_{58}$, $W_4O_{11}$, and the like. When the value of X is 2.45 or higher, the material is chemically stable, and an unwanted crystal phase of $WO_2$ can be completely prevented from forming in the neat absorbing material. When the value of X is 2.999 or less, an adequate quantity of free electrons is generated, and an efficient heat absorbing material is obtained. A $WO_X$ compound of the type in which the range of X satisfies the relation $2.45 \leqq X \leqq 2.95$ is included in so-called Magneli phase compounds.

Preferred examples of composite tungsten oxide microparticles that have a hexagonal crystal structure and are indicated by the abovementioned general formula $M_YWO_Z$ include a type of composite tungsten oxide microparticles that include one or more elements selected from Cs, Rb, K, Tl, In, Ba, Li, Ca, Sr, Fe, and Sn as element M.

The added quantity Y of element M is preferably 0.001 to 1.0, and more preferably near 0.33. The reason for this is that the value of Y computed theoretically from the hexagonal crystal structure is 0.33, and preferred optical characteristics are obtained when the added quantity is approximately 0.33. Typical examples include $Cs_{0.33}WO_3$, $Rb_{0.33}WO_3$, $K_{0.33}WO_3$, $Ba_{0.33}WO_3$, and the like, but useful heat absorbing characteristics can be obtained when Y and Z are in the abovementioned ranges.

It is important that spinning, extending, and other fiber processing methods are not adversely affected by the grain size of the abovementioned microparticles. A preferred average grain size is therefore 5 μm or less, and 3 μm or less is more preferred. When the average grain size is 5 μm or less, it is possible to prevent filter clogging, thread breakage, and other reduction of spinning abilities in the spinning process. An average grain size of 5 μm or less is also preferred because thread breakage and other problems can occur during stretching, and it can be difficult to uniformly mix and disperse the grains in the starting material used for spinning even when spinning is possible.

When dyeing properties and other design properties of a garment or other fiber material that includes the heat absorbing material are considered, it is clear that the heat absorbing material must efficiently absorb near infrared rays while maintaining transparency. The heat absorbing component of the present invention that includes tungsten oxide microparticles and/or composite tungsten oxide microparticles significantly absorbs light in the near infrared region, particularly light having a wavelength in the vicinity of 900 to 2200 nm, and the colors transmitted by the heat absorbing component are therefore mostly blues and greens. Therefore, although transparency can be maintained when the grain size of the microparticles is smaller than 800 nm, the grain size is set to 200 nm or less, more preferably 100 nm or less, when transparency is emphasized. On the other hand, commercial production is facilitated when the grain size is 1 nm or greater.

Since the heat absorbing capacity per unit weight of the tungsten oxide microparticles and composite tungsten oxide microparticles is extremely high, the heat absorbing effects of the microparticles are demonstrated using a quantity thereof that is about ¼ to 1/10 that of ITO or ATO. Specifically, the content of tungsten oxide microparticles and/or composite tungsten oxide microparticles included in the surface and/or interior of the fibers is preferably between 0.001 wt % and 80 wt %. Furthermore, when the cost of the starting material or the weight of the fibers after addition of the microparticles is considered, a content of 0.005 wt % to 50 wt % is preferably selected. When the content is 0.001 wt % or higher, adequate heat absorbing effects can be obtained even when the fabric is thin, and when the content is 80 wt % or lower, it is possible to prevent a reduction of spinning ability due to filter clogging, thread breakage, and other problems in the spinning process. A content of 50 wt % or lower is more preferred. Only a small added quantity of the microparticles is needed, and there is therefore no adverse effect on the physical properties of the fiber.

Microparticles that have the ability to radiate far infrared rays may also be included in the surface and/or interior of the fibers in addition to the heat absorbing material of the present invention. Examples of [the far infrared radiating microparticles] include $ZrO_2$, $SiO_2$, $TiO_2$, $Al_2O_3$, $MnO_2$, MgO, $Fe_2O_3$, CuO, and other metal oxides; ZrC, SiC, TiC, and other carbides; and ZrN, $Si_3N_4$, AlN, and other nitrides and the like.

The tungsten oxide microparticles and/or composite tungsten oxide microparticles that constitute the heat absorbing material of the present invention have the characteristic of absorbing solar energy at a wavelength of 0.3 to 3 μm. The microparticles also selectively absorb wavelengths near 0.9 to 2.2 μm in the near infrared region in particular, and convert this energy to heat or re-radiate the energy. The microparticles that radiate far infrared rays have the ability to acquire the energy absorbed by the tungsten oxide microparticles and/or composite tungsten oxide microparticles that constitute the heat absorbing material, convert the energy to heat energy of a mid/far infrared wavelength, and radiate the heat energy. Microparticles of $ZrO_2$, for example, convert the energy to heat energy having a wavelength of 2 to 20 μm, and radiate the heat energy. Accordingly, the microparticles that can radiate far infrared rays are present in the interior and on the surface of the fibers together with the tungsten oxide microparticles and/or composite tungsten oxide microparticles that radiate far infrared rays, whereby the solar energy that is absorbed by the heat absorbing material is efficiently consumed in the interior and on the surface of the fibers, and heat is retained more effectively.

The content of the microparticles for radiating far infrared rays in the surface and/or interior of the fibers is preferably between 0.001 wt % and 80 wt %. When the content is 0.001 wt % or higher, adequate heat energy radiating effects can be obtained even when the fabric is thin, and when the content is 80 wt % or lower, it is possible to prevent a reduction of spinning ability due to filter clogging, thread breakage, and other problems in the spinning process.

The fiber used in the present invention may be selected from various types of fiber according to the application, and it is possible to use any fiber selected from a synthetic fiber, a semisynthetic fiber, a natural fiber, a reclaimed fiber, and an inorganic fiber; or a textile blend, doubled yarn, or mixed yarn formed by combining filaments of the same. A synthetic fiber is preferred in terms of sustainability of heat retention and the simplicity of the method by which the inorganic microparticles are included in the fibers.

The synthetic fiber used in the present invention is not particularly limited, and examples thereof include polyurethane fiber, polyamide fiber, acrylic fiber, polyester fiber, polyolefin fiber, polyvinyl alcohol fiber, polyvinylidene chloride fiber, polyvinyl chloride fiber, polyether ester fiber, and the like.

Examples of polyamide fibers include nylon, nylon 6, nylon 66, nylon 11, nylon 610, nylon 612, aromatic nylon, aramid, and the like.

Examples of acrylic fibers include polyacrylonitrile, acrylonitrile-vinyl chloride copolymer, modacrylic fiber, and the like.

Examples of polyester fibers include polyethylene terephthalate, polybutylene terephthalate, polytrimethylene terephthalate, polyethylene naphthalate, and the like.

Examples of polyolefin fibers include polyethylene, polypropylene, polystyrene, and the like.

Examples of polyvinyl alcohol fibers include vinylon and the like.

Examples of polyvinylidene chloride fibers include vinylidene and the like.

Examples of polyvinyl chloride fibers include polyvinyl chloride and the like.

Examples of polyether ester fibers include Rexe, Success, and the like.

When the fibers used in the present invention are semisynthetic fibers, examples thereof include cellulose fibers, protein fibers, chlorinated rubber, hydrochlorinated rubber, and the like.

Examples of cellulose fibers include acetate, triacetate, acetate oxide, and the like.

Examples of protein fibers include promix and the like.

When the fibers used in the present invention are natural fibers, examples thereof include vegetable fiber, animal fiber, mineral fiber, and the like.

Examples of vegetable fibers include cotton, ceiba, flax, hemp, jute, manila hemp, sisal hemp, New Zealand flax, luobuma, palm fibers, rush, straw, and the like.

Examples of animal fibers include wool, goat hair, mohair, cashmere, alpaca, angora, camel, vicuna, and other wools; and silk, down, feathers, and the like.

Examples of mineral fibers include asbestos, amiantho, and the like.

When the fibers used in the present invention are reclaimed fibers, examples thereof include cellulose fiber, protein fiber, algin fiber, rubber fiber, chitin fiber, mannan fiber, and the like.

Examples of cellulose fibers include rayon, viscous rayon, cupra, polynosic, cuprammonium rayon, and the like.

Examples of protein fibers include casein fiber, peanut protein fiber, maize protein fiber, soy protein fiber, reclaimed silk, and the like.

When the fibers used in the present invention are inorganic fibers, examples thereof include metal fibers, carbon fibers, silicate fibers, and the like.

Examples of metal fibers include metal fibers, gold thread, silver thread, heat resistant alloy fibers, and the like.

Examples of silicate fibers include glass fibers, slag fibers, rock fibers, and the like.

The cross sectional shape of the fibers of the present invention is not particularly limited, but the cross section of the fibers may be circular, triangular, hollow, flat, Y shaped, star shaped, in the shape of a core and sheath, or in another shape, for example. Various shapes allow for inclusion of the microparticles in the surface and/or interior of the fibers. When a core and sheath shape is adopted, for example, the microparticles may be included in the core portion of the fibers as well as in the sheath portion. The shape of the fibers of the present invention may be that of a filament (long fiber) or a staple (short fiber).

Depending on the application, it is possible to include and use antioxidants, flame retardants, deodorants, insecticides, antibacterial agents, UV absorbing agents, and the like in the fiber of the present invention in ranges that do not compromise the performance of the fiber.

No particular limitations are placed on the method for uniformly including the inorganic microparticles in the surface and/or interior of the fibers of the present invention. Examples of methods that may be used include (1) a method whereby the inorganic microparticles are directly mixed and spun with the starting material polymer of a synthetic fiber; (2) a method whereby a master batch is manufactured in advance in which the inorganic microparticles are added in a large concentration to a portion of the starting material polymer, and spinning is performed after the master batch is diluted to a prescribed concentration; (3) a method whereby the inorganic microparticles are uniformly dispersed in advance in the starting material polymer or an oligomer solution, and the dispersion solution is used to synthesize the desired starting material polymer while the inorganic microparticles are simultaneously dispersed uniformly in the starting material polymer, after which spinning is performed; (4) a method whereby a binding agent or the like is used to bond the inorganic microparticles to the surfaces of fibers obtained by spinning in advance; and other methods.

A preferred example of the method described in (2) for manufacturing a master batch and performing spinning after the master batch is diluted and adjusted will next be described in detail.

The method for manufacturing the abovementioned master batch is not particularly limited. For example, the master batch may be prepared as a mixture in which microparticles are uniformly dispersed in a thermoplastic resin by a process in which a liquid dispersion of tungsten oxide microparticles and/or composite tungsten oxide microparticles, grains or pellets of a thermoplastic resin, and other optional additives are uniformly melt mixed and stripped of solvents using a ribbon blender, tumbler, Nauta mixer, Henschel mixer, super mixer, planetary mixer, or other mixer; and a Banbury mixer, kneader, roller, kneader ruder, uniaxial extender, biaxial extender, or other kneading machine.

After the liquid dispersion of the tungsten oxide microparticles and/or composite tungsten oxide microparticles is prepared, the solvent in the liquid dispersion may be removed by a publicly known method; and the resultant powder, grains or pellets of a thermoplastic resin, and other optional additives may be uniformly melt mixed to manufacture a mixture in which the microparticles are uniformly dispersed in the thermoplastic resin. Alternatively, a method may be used in which grains of the tungsten oxide microparticles and/or composite tungsten oxide microparticles are directly added to the thermoplastic resin, and the mixture is uniformly melt mixed.

A master batch that includes the heat absorbing component may be obtained by kneading the mixture of the thermoplastic resin and tungsten oxide microparticles and/or composite tungsten oxide microparticles obtained by the above-mentioned method in a vented single-screw or twin-screw extruder to produce pellets.

The abovementioned methods (1) through (4) for uniformly including the inorganic microparticles in the fiber used in the present invention will be described herein using specific examples.

Method (1): When the fibers used are polyester fibers, for example, a liquid dispersion of the tungsten oxide microparticles and/or composite tungsten oxide microparticles is added to and uniformly mixed in a blender with pellets of polyethylene terephthalate resin, which is a thermoplastic resin, and the solvent is then removed. The mixture from which the solvent is removed is melt kneaded in a twin-screw extruder to obtain a master batch that includes the tungsten oxide microparticles and/or composite tungsten oxide microparticles. The desired quantity of a master batch composed of polyethylene terephthalate to which the microparticles are not added, and the master batch that includes the tungsten oxide microparticles and/or composite tungsten oxide microparticles are melt mixed near the melting temperature of the resin, and spinning is performed according to the common method.

Method (2): The desired quantity of a master batch composed of polyethylene terephthalate to which the microparticles are not added, and the master batch that includes the tungsten oxide microparticles and/or composite tungsten oxide microparticles, are melt mixed near the melting temperature of the resin, and spinning is performed according to the common method in the same manner as in method (1), except that method (2) uses a master batch that includes the tungsten oxide microparticles and/or composite tungsten oxide microparticles and is prepared in advance.

Method (3): When the fibers used are urethane fibers, an organic diisocyanate and a polymer diol that includes the tungsten oxide microparticles and/or composite tungsten oxide microparticles are reacted in a twin-screw extruder to synthesize a prepolymer that contains an isocyanate terminal group, after which a chain extender is reacted with the prepolymer, and a polyurethane solution (starting material polymer) is manufactured. The polyurethane solution is spun according to the common method.

Method (4): In order to bond the inorganic microparticles to the surfaces of natural fibers, for example, a treatment solution is first prepared that is a mixture of water or another solvent, the tungsten oxide microparticles and/or composite tungsten oxide microparticles, and at least one type of binder resin selected from acrylic, epoxy, urethane, and polyester. The natural fibers are then dipped in the prepared treatment solution, or the natural fibers are impregnated with the prepared treatment solution by padding, printing, spraying, or another method, and are dried to bond the tungsten oxide microparticles and/or composite tungsten oxide microparticles to the natural fibers. Besides the natural fibers described above, method (4) may also be applied to semisynthetic fibers, reclaimed fibers, or inorganic fibers, or to a textile blend, doubled yarn, or mixed yarn of the same.

When the abovementioned methods (1) through (4) are implemented, any of the methods may be used insofar as the method for dispersing the tungsten oxide microparticles and/or composite tungsten oxide microparticles and the inorganic microparticles as the microparticles of the far infrared radiating substance is capable of uniformly dispersing the inorganic microparticles in the solution. For example, a method that uses a media stirring mill, a ball mill, a sand mill, ultrasonic dispersion, or the like may be suitably applied.

The medium in which the abovementioned inorganic microparticles are dispersed is not particularly limited, and can be selected according to the fibers mixed therein. For example, water, or alcohols, ethers, esters, ketones, aromatic compounds, and various types of other common organic solvents may be used.

Furthermore, the liquid dispersion of the inorganic microparticles may be directly mixed with the fibers or the polymer that is the starting material of the fibers when the abovementioned inorganic microparticles are bonded to and mixed with the fibers and the polymer that is the starting material for the fibers. Acid or alkali may be optionally added to the liquid dispersion of inorganic microparticles to adjust the pH thereof, and various types of surfactants, coupling agents, and the like are also preferably added to further enhance the dispersion stability of the microparticles.

Furthermore, in order to enhance the weather resistance of the abovementioned inorganic microparticles, the surfaces of the tungsten oxide microparticles and/or composite tungsten oxide microparticles are preferably coated with a compound that contains one or more elements selected from silicon, zirconium, titanium, and aluminum. These compounds are fundamentally transparent and do not reduce the transmittance of visible light by the inorganic microparticles when added thereto, and therefore do not adversely affect the design properties of the fiber. These compounds are also preferably oxides. This is because oxides of these compounds have strong far infrared absorbing capability, and are therefore also effective at retaining heat.

As described above, the near infrared absorbing fiber of the present invention makes it possible to provide a fiber that has excellent heat retaining properties even when a small quantity of the inorganic microparticles is added, and that efficiently absorbs heat from sunlight and the like using a small quantity of tungsten oxide microparticles and/or composite tungsten oxide microparticles as the heat absorbing component, by uniformly including the microparticles in the fiber, and also uniformly including microparticles for radiating far infrared rays in the fiber. Since the fiber also has satisfactory weather resistance, excellent transparency, and low cost, and includes a small added quantity of inorganic microparticles, adverse effects on the strength, elongation, and other fundamental physical properties of the fiber can be prevented without compromising the design properties of the fiber article. As a result, the fiber of the present invention can be applied in winter clothing, sports apparel, stockings, curtains, and other fiber articles in which heat retaining properties are required, as well as in industrial fiber materials and various other applications.

An example of a method for manufacturing tungsten oxide microparticles indicated by the general formula $WO_X$ and composite tungsten oxide microparticles indicated by the general formula $M_YWO_Z$ will be described herein as an example of the method for manufacturing the tungsten oxide microparticles and the composite tungsten oxide microparticles.

The abovementioned tungsten oxide microparticles and/or composite tungsten oxide microparticles can be obtained by mixing a prescribed measured weight of a tungsten compound as the starting material of the oxide microparticles, and heat treating the tungsten compound in an inert gas atmosphere or a reducing gas atmosphere.

The tungsten compound that is the starting material is preferably any one or more types of compounds selected from tungsten trioxide powder, tungsten dioxide powder, and a tungsten oxide hydrate; tungsten hexachloride powder or ammonium tungstenate powder; a tungsten oxide hydrate powder obtained by dissolving tungsten hexachloride in alcohol and drying the solution; a tungsten oxide hydrate powder obtained by dissolving tungsten hexachloride in alcohol, adding water, and drying the precipitate; and a metal tungsten powder and tungsten oxide powder obtained by drying an aqueous solution of ammonium tungstenate.

The use of tungsten oxide hydrate powder, tungsten trioxide, or a powder of a tungsten compound obtained by drying an aqueous solution of ammonium tungstenate is preferred from the perspective of easy manufacturing of the tungsten oxide microparticles. When the starting material for manufacturing composite tungsten oxide microparticles is a solution, the use of an aqueous solution of ammonium tungstenate or a solution of tungsten hexachloride is more preferred for the sake of enabling easy uniform mixing of the elements. These starting materials can be used to obtain microparticles having heat absorbing capacity that include the abovementioned tungsten oxide microparticles and/or composite tungsten oxide microparticles, by heat treating the starting materials in an inert gas atmosphere or a reducing gas atmosphere.

The starting material of the microparticles having heat absorbing capacity that include the abovementioned composite tungsten oxide microparticles is the same tungsten compound as the starting material of the microparticles having heat absorbing capacity that include the abovementioned tungsten oxide microparticles, but the starting material used is a tungsten compound that furthermore includes an element M in the form of an elemental substance or compound. The starting materials are preferably mixed in a solution in order to manufacture a tungsten compound that is a starting material in which each component is uniformly mixed at the molecular level, and the tungsten compound that contains element M is preferably soluble in water, an organic solvent, or another solvent. Tungstenates, chloride salts, nitrates, sulfates, oxalates, oxides, carbonates, hydroxides, and other compounds that contain element M can be cited as examples, but these examples are not limiting, and a soluble compound is preferred.

Below is another detailed description of the starting materials for manufacturing the abovementioned tungsten oxide microparticles and composite tungsten oxide microparticles.

Any one or more types of compounds selected from tungsten trioxide powder, tungsten dioxide powder, and a tungsten oxide hydrate; tungsten hexachloride powder and ammonium tungstenate powder; a tungsten oxide hydrate powder obtained by dissolving tungsten hexachloride in alcohol and drying the solution; a tungsten oxide hydrate powder obtained by dissolving tungsten hexachloride in alcohol, adding water, and drying the precipitate; and a metal tungsten powder and tungsten oxide powder obtained by drying an aqueous solution of ammonium tungstenate may be used as the tungsten compound that is the starting material for obtaining the tungsten oxide microparticles indicated by the general formula $W_YO_Z$. However, tungsten oxide hydrate powder, tungsten trioxide, or a powder of a tungsten compound obtained by drying an aqueous solution of ammonium tungstenate is preferred for use from the perspective of easy manufacturing.

The starting material used to obtain the composite tungsten oxide microparticles that are indicated by the general formula $M_YWO_Z$ and contain element M may be a powder that is a mixture of a powder substance or compound that includes element M, and a powder of any one or more types of compounds selected from tungsten trioxide powder, tungsten dioxide powder, and a tungsten oxide hydrate; tungsten hexachloride powder and ammonium tungstenate powder; a tungsten oxide hydrate powder obtained by dissolving tungsten hexachloride in alcohol and drying the solution; a tungsten oxide hydrate powder obtained by dissolving tungsten hexachloride in alcohol, adding water, and drying the precipitate; and a metal tungsten powder and tungsten oxide powder obtained by drying an aqueous solution of ammonium tungstenate.

When the tungsten compound that is the starting material for obtaining the composite tungsten oxide microparticles is a solution or liquid dispersion, it is easy to uniformly mix the elements.

From this perspective, the starting material of the composite tungsten oxide microparticles is more preferably a powder obtained by drying a mixture of an alcohol solution of tungsten hexachloride or an aqueous solution of ammonium tungstenate, and a solution of a compound that includes the aforementioned element M.

In the same manner, the starting material of the composite tungsten oxide microparticles is also preferably a powder obtained by drying a mixture composed of a liquid dispersion in which a precipitate is formed by adding water after dissolving tungsten hexachloride in alcohol, and further composed of a powder substance or compound that includes the element M, or a solution of a compound that includes the element M.

Examples of compounds that include element M include tungstenates, chloride salts, nitrates, sulfates, oxalates, oxides, carbonates, hydroxides, and other compounds of element M, but these examples are not limiting, and a soluble compound is preferred. When tungsten oxide hydrate powder or tungsten trioxide is used together with a carbonate or hydroxide of element M in the commercial production of the composite tungsten oxide microparticles, harmful gases and the like do not form in the heat treatment stage and other stages, and this manufacturing method is therefore preferred.

A temperature of 650° C. or above is preferred as a condition for the heat treatment of the tungsten oxide microparticles and composite tungsten oxide microparticles in an inert atmosphere. Starting material that is heat treated at 650° C. or above has adequate heat absorbing capacity, and efficiently forms microparticles that have heat absorbing capacity. The inert gas used may be Ar, $N_2$, or another inert gas. Heat treatment in a reducing atmosphere may be performed under conditions in which the starting material is first heat treated in a reducing gas atmosphere at a temperature of 100° C. to 850° C., and is then heat treated in an inert gas atmosphere at a temperature of 650° C. to 1200° C. The reducing gas used at this time is not particularly limited, but $H_2$ is preferred. When $H_2$ is used as the reducing gas, the composition of the reducing atmosphere preferably includes an $H_2$ volume ratio of 0.1% or higher, and more preferably 2% or higher. Reduction can be carried out efficiently when the volume ratio of $H_2$ is 0.1% or higher.

EXAMPLES

The present invention will be described in further detail hereinafter using examples and comparative examples. However, the present invention is in no way limited by the examples described below.

Example 1

Microparticles (specific surface area: 20 $m^2/g$) of $Cs_{0.33}WO_3$ in the amount of 10 weight parts, 80 weight parts of toluene, and 10 weight parts of a dispersing agent for microparticles were mixed and formed into a dispersion in a media stirring mill, and a liquid dispersion of $Cs_{0.33}WO_3$ microparticles having an average dispersed grain size of 80 nm was created (solution A). The toluene in (solution A) was then removed using a spray dryer, and (powder A) as a powder dispersion of $Cs_{0.33}WO_3$ was obtained.

The (powder A) thus obtained was added to pellets of polyethylene terephthalate resin (a thermoplastic resin) and uniformly mixed in a blender, after which the mixture was melt kneaded and extruded by a twin-screw extruder, the extruded strands were cut into pellets, and a master batch was obtained that included 80 wt % of $Cs_{0.33}WO_3$ microparticles as the heat absorbing component.

The master batch of polyethylene terephthalate including 80 wt % of $Cs_{0.33}WO_3$ microparticles; and a master batch of polyethylene terephthalate prepared by the same method and not including inorganic microparticles were mixed in a weight ratio of 1:1, and a mixed master batch including 40 wt % of $Cs_{0.33}WO_3$ microparticles was obtained. The average grain size of the $Cs_{0.33}WO_3$ microparticles at this time was observed to be 25 nm from a dark field image formed by a single diffraction ring using a TEM (Transmission Electron Microscope) (hereinafter referred to as the dark field method).

The master batch including 40 wt % of $Cs_{0.33}WO_3$ microparticles was melt spun and stretched to produce a polyester multifilament yarn. The obtained polyester multifilament yarn was cut to create polyester staples, which were used to manufacture a spun yarn. A knit article having heat retaining properties was then obtained using the spun yarn. (The insolation reflectance of the fabricated knit article sample was adjusted to 8%. The insolation reflectance of the knit article sample was also adjusted to 8% in all of Examples 2 through 7 and Comparative Example 1 described hereinafter.)

The spectral characteristics of the fabricated knit article were measured according to the transmittance of light having a wavelength of 200 to 2100 nm by using a spectrophotometer manufactured by Hitachi, Ltd., and the insolation absorption rate was computed in accordance with JIS A5759. The insolation absorption rate was computed from the following equation:

(Insolation absorption rate (%))=100%−(Insolation transmittance (%))−(Insolation reflectance (%)).

The computed insolation absorption rate was 49.98%.

The temperature increasing effect of the back surface of the fabric of the fabricated knit article was measured as described below.

In an environment having a temperature of 20° C. and a relative humidity of 60%, a lamp (Seric solar simulator XL-03E50 rev.) having a spectrum similar to sunlight was radiated from a distance of 30 cm from the fabric of the knit article, and the temperature of the back surface of the fabric was measured at prescribed times (0 s, 30 s, 60 s, 180 s, 360 s, and 600 s) by using a radiation thermometer (Minolta HT-11). The results are shown in Table 1. The results obtained in Examples 2 through 7 and Comparative Example 1 described hereinafter are also shown in Table 1.

Example 2

Microparticles of $Cs_{0.33}WO_3$ and microparticles of $ZrO_2$ were mixed in a weight ratio of 1:1.5 to form a mixture. A master batch of polyethylene terephthalate that included 80 wt % of the mixture was then created by the same method as in Example 1. The average grain sizes of the $Cs_{0.33}WO_3$ microparticles and the $ZrO_2$ microparticles at this time were observed to be 25 nm and 30 nm, respectively, by the dark field method using a TEM.

A multifilament yarn was manufactured by the same method as in Example 1 using the master batch that included the abovementioned two types of microparticles. The obtained multifilament yarn was cut to create polyester staples, and a spun yarn was then manufactured by the same method as in Example 1. A knit article was obtained using the spun yarn.

The spectral characteristics of the knit article thus fabricated were measured by the same method as in Example 1. The insolation absorption rate was 55.06%. The temperature increasing effect of the back surface of the fabric of the fabricated knit article was measured by the same method as in Example 1. The results are shown in Table 1.

Example 3

A master batch of polyethylene terephthalate including 80 wt % of $Rb_{0.33}WO_3$ microparticles was created by the same method as in Example 1. The average grain size of the $Rb_{0.33}WO_3$ microparticles was observed to be 20 nm by the dark field method using a TEM.

A multifilament yarn was manufactured by the same method as in Example 1 using the master batch that included the abovementioned microparticles. The obtained multifilament yarn was cut to create polyester staples, and a spun yarn was then manufactured by the same method as in Example 1. A knit article was obtained using the spun yarn.

The spectral characteristics of the knit article thus fabricated were measured by the same method as in Example 1. The insolation absorption rate was 54.58%. The temperature increasing effect of the back surface of the fabric of the fabricated knit article was measured by the same method as in Example 1. The results are shown in Table 1.

Example 4

A master batch of polyethylene terephthalate including 50 wt % of $W_{18}O_{49}$ microparticles was created by the same method as in Example 1. The average grain size of the $W_{18}O_{49}$ microparticles was observed to be 20 nm by the dark field method using a TEM.

A multifilament yarn was manufactured by the same method as in Example 1 using the master batch that included the abovementioned microparticles. The obtained multifilament yarn was cut to create polyester staples, and a spun yarn was then manufactured by the same method as in Example 1. A knit article was obtained using the spun yarn.

The spectral characteristics of the knit article thus fabricated were measured by the same method as in Example 1. The insolation absorption rate was 30.75%. The temperature increasing effect of the back surface of the fabric of the fabricated knit article was measured by the same method as in Example 1. The results are shown in Table 1.

Comparative Example 1

A multifilament yarn was manufactured by the same method as in Example 1 using a master batch of polyethylene terephthalate to which the inorganic microparticles described in Example 1 were not added.

The obtained multifilament yarn was cut to create polyester staples, and a spun yarn was then manufactured by the same method as in Example 1. A knit article was obtained using the spun yarn.

The spectral characteristics of the knit article thus fabricated were measured by the same method as in Example 1. The insolation absorption rate was 3.74%. The temperature increasing effect of the back surface of the fabric of the fabricated knit article was measured by the same method as in Example 1. The results are shown in Table 1.

Example 5

A master batch of nylon 6 including 30 wt % of $Cs_{0.33}WO_3$ microparticles was prepared by the same method as in Example 1 except that pellets of nylon 6 were used as the thermoplastic resin. This master batch was mixed in a weight ratio of 1:1 with a master batch of nylon 6 which was prepared by the same method and to which the inorganic microparticles were not added, and a mixed master batch that included 15 wt % of $Cs_{0.33}WO_3$ microparticles was obtained. The average grain size of the $Cs_{0.33}WO_3$ microparticles at this time was observed to be 25 nm by the dark field method using a TEM.

The mixed master batch including 15 wt % of the $Cs_{0.33}WO_3$ microparticles was melt spun and stretched, and a nylon multifilament yarn was manufactured. The obtained multifilament yarn was cut to create nylon staples, which were then used to manufacture a spun yarn. A nylon fiber article having heat retaining properties was obtained using the spun yarn.

The spectral characteristics of the nylon fiber article thus fabricated were measured by the same method as in Example 1. The insolation absorption rate was 51.13%. The temperature increasing effect of the back surface of the fabric of the fabricated nylon fiber article was measured by the same method as in Example 1. The results are shown in Table 1.

Example 6

A master batch of polyacrylonitrile including 50 wt % of $Cs_{0.33}WO_3$ microparticles was created by the same method as in Example 1 except that acrylic resin pellets were used as the thermoplastic resin. This master batch was mixed in a weight ratio of 1:1 with a master batch of polyacrylonitrile which was prepared by the same method and to which the inorganic microparticles were not added, and a mixed master batch that included 25 wt % of $Cs_{0.33}WO_3$ microparticles was obtained. The average grain size of the $Cs_{0.33}WO_3$ microparticles at this time was observed to be 25 nm by the dark field method using a TEM.

The mixed master batch including 25 wt % of the $Cs_{0.33}WO_3$ microparticles was melt spun and stretched, and an acrylic multifilament yarn was manufactured. The obtained multifilament yarn was cut to create acrylic staples, which were then used to manufacture a spun yarn. An acrylic fiber article having heat retaining properties was obtained using the spun yarn.

The spectral characteristics of the acrylic fiber article thus fabricated were measured by the same method as in Example 1. The insolation absorption rate was 53.91%. The temperature increasing effect of the back surface of the fabric of the fabricated acrylic fiber article was measured by the same method as in Example 1. The results are shown in Table 1.

Example 7

Polytetramethylene ether glycol (PTG2000) including 30 wt % of $Cs_{0.33}WO_3$ microparticles was reacted with 4,4-diphenylmethane diisocyanate, and a prepolymer containing an isocyanate terminal group was prepared. As chain extenders, 1,4-butane diol and 3-methyl-1,5-pentane diol were reacted with the prepolymer, polymerization was performed, and a thermoplastic polyurethane solution was manufactured. The average grain size of the $CS_{0.33}WO_3$ microparticles at this time was observed to be 25 nm by the dark field method using a TEM.

The thermoplastic polyurethane solution thus obtained was spun as a starting material and stretched to obtain a polyurethane elastic fiber. A urethane fiber article having heat retaining properties was obtained using the polyurethane elastic fiber.

The spectral characteristics of the urethane fiber article thus fabricated were measured by the same method as in Example 1. The insolation absorption rate was 52.49%. The temperature increasing effect of the back surface of the fabric of the fabricated urethane fiber article was measured by the same method as in Example 1. The results are shown in Table 1.

Conclusion

When Comparative Example 1 was compared with Examples 1 through 7 described above, it was apparent that excellent heat retaining properties were obtained, and the temperature of the back surface of the fabric of the fiber articles was increased an average of 15° C. or more by including the tungsten oxide microparticles and/or composite tungsten oxide microparticles in the fibers.

TABLE 1

| | | Lamp Radiation Time (seconds) | | | | | |
|---|---|---|---|---|---|---|---|
| | | 0 | 30 | 60 | 180 | 360 | 600 |
| Fabric Back Surface Temperature (° C.) | Example 1 | 26.3 | 38.8 | 42 | 43.1 | 43.2 | 43.4 |
| | Example 2 | 26.2 | 45.2 | 49.2 | 50.8 | 51.1 | 50.9 |
| | Example 3 | 26.4 | 43 | 47.4 | 49.2 | 49.7 | 49.4 |
| | Example 4 | 26.6 | 35.9 | 37.8 | 38.4 | 38.2 | 38.6 |
| | Example 5 | 26.3 | 39.7 | 42.9 | 44 | 43.9 | 44 |
| | Example 6 | 26.9 | 42.1 | 46.6 | 47.8 | 47.7 | 47.7 |
| | Example 7 | 26 | 40.8 | 44.2 | 45.5 | 45.6 | 45.7 |
| | Comparative Example 1 | 26 | 27.9 | 29.5 | 30 | 30.5 | 30.1 |

The invention claimed is:

1. A fiber comprising tungsten oxide microparticles and/or composite tungsten oxide microparticles in a surface and/or interior of the fiber, wherein:

the fiber is a near infrared absorbing fiber in which the content of the microparticles is 0.001 wt % to 80 wt % with respect to a solid portion of the fiber;

said tungsten oxide microparticles and/or composite tungsten oxide microparticles have a grain size of 1 nm to 800 nm;

said tungsten oxide microparticles are represented by the general formula $WO_x$ with $2.45 \leqq X \leqq 2.999$; and said composite tungsten oxide microparticles have a hexagonal crystal structure and are represented by the general formula $M_yWO_z$ where M is at least one element selected from the group consisting of Cs, Rb, K, Tl, In, Ba, Li, Ca, Sr, Fe, and Sn; $0.001 \leqq Y \leqq 1.0$; and $2.2 \leqq Z \leqq 3.0$.

2. The near infrared absorbing fiber of claim 1, further comprising microparticles of a far infrared radiating substance in the surface and/or interior of the near infrared absorbing fiber, wherein:

the microparticles of the far infrared radiating substance are contained in the near infrared absorbing fiber in an amount of 0.001 wt % to 80 wt % with respect to a solid portion of the fiber.

3. The near infrared absorbing fiber of claim 1, wherein said fiber is a member selected from the group consisting of a synthetic fiber, a semisynthetic fiber, a natural fiber, a reclaimed fiber, and an inorganic fiber; or a textile blend, doubled yarn, or mixed yarn formed by combining filaments of the same.

4. The near infrared absorbing fiber of claim 3, wherein said synthetic fiber is selected from the group consisting of polyurethane fiber, polyamide fiber, acrylic fiber, polyester fiber, polyolefin fiber, polyvinyl alcohol fiber, polyvinylidene chloride fiber, polyvinyl chloride fiber, and polyether ester fiber.

5. The near infrared absorbing fiber of claim 3, wherein said semisynthetic fiber is selected from the group consisting of cellulose fiber, protein fiber, chlorinated rubber, and hydrochlorinated rubber.

6. The near infrared absorbing fiber of claim 3, wherein said natural fiber is selected from the group consisting of vegetable fiber, animal fiber, and mineral fiber.

7. The near infrared absorbing fiber of claim 3, wherein said reclaimed fiber is selected from the group consisting of cellulose fiber, protein fiber, algin fiber, rubber fiber, chitin fiber, and mannan fiber.

8. The near infrared absorbing fiber of claim 3, wherein said inorganic fiber is selected from the group consisting of metal fiber, carbon fiber, and silicate fiber.

9. The near infrared absorbing fiber of claim 1, wherein a surface of said tungsten oxide microparticles and/or composite tungsten oxide microparticles is covered by a compound that contains at least one element selected from the group consisting of silicon, zirconium, titanium, and aluminum.

10. The near infrared absorbing fiber of claim 9, wherein said compound is an oxide.

11. A fiber article comprising the near infrared absorbing fiber of claim 1.

* * * * *